United States Patent [19]

MacPhee et al.

[11] 4,344,361

[45] Aug. 17, 1982

[54] AUTOMATIC BLANKET CYLINDER CLEANER

[75] Inventors: John MacPhee, Rowayton, Conn.; Charles R. Gasparrini, Rye, N.Y.; Karlheinz E. H. Arnolds, Stamford, Conn.

[73] Assignee: Baldwin-Gegenheimer Corporation, Stamford, Conn.

[21] Appl. No.: 31,511

[22] Filed: Apr. 19, 1979

[51] Int. Cl.[3] ..... B41F 35/06; B41L 41/06

[52] U.S. Cl. ..... 101/425; 15/256.51; 198/494; 101/141; 355/15

[58] Field of Search ..... 101/425; 15/256.51, 15/256.52, 256.53; 355/15; 198/494

[56] References Cited

U.S. PATENT DOCUMENTS

| | | | |
|---|---|---|---|
| 643,372 | 2/1900 | Cornwall | 101/425 |
| 1,408,633 | 3/1922 | Parsons | 101/425 |
| 1,566,358 | 12/1925 | White | 15/256.51 |
| 2,525,982 | 10/1950 | Wescott | 101/425 |
| 3,026,842 | 3/1962 | Faeber | 15/256.51 |
| 3,411,444 | 11/1968 | Boneschi | 15/256.51 |
| 3,457,857 | 7/1969 | Burger | 101/425 |
| 3,654,654 | 4/1972 | Abreu | 355/15 |
| 3,717,409 | 2/1973 | Hespenheide | 355/15 |
| 3,785,286 | 1/1974 | Giori | 101/425 |
| 3,800,702 | 4/1974 | Roberts | 15/256.51 |

*Primary Examiner*—Clyde I. Coughenour

*Attorney, Agent, or Firm*—Morgan, Finnegan, Pine, Foley & Lee

[57] ABSTRACT

An automatic blanket cylinder cleaner having a cleaner fabric adapted to contact the blanket cylinder. A cleaning cloth supply roller provides cloth for the cloth take-up roll. Positioned between these rolls is a water solvent dispensing tube, a solvent dispensing tube and an inflatable and deflatable mechanical loosening means which is adapted to move the cleaning fabric into and out of contact with the blanket cylinder. An air dryer means dries the blanket cylinder after the cleaning of debris. An advancing means advances the cleaning cloth intermittently onto the take-up roller by a control means in contact with the take-up roll which provides for uniform cloth advance during the cleaning cycle. There is a control means providing automatic and manual control.

12 Claims, 13 Drawing Figures

LIQUID DISPENSING SYSTEM
REG.
102
AIR SUPPLY 100
104
108
106
FS
118
112
120
112B
111
110
112A
121
114
116
123
SPRAY BAR
TO ADDITIONAL UNITS

AIR SUPPLY 100
BLADDER SYSTEM
REG.
102
101
122
BLADDER
REG.
TO ADDITIONAL UNITS

AIR SUPPLY 100
CLOTH ADVANCING SYSTEM
REG.
102
99
103
51
49
53
CLOTH ADVANCING MECHANISM
TO CRANK ARM
TO ADDITIONAL UNITS

100
AIR SUPPLY
AIR SPRAYING SYSTEM
REG.
102
104
105
AIR DRYING SPRAY BAR
TO ADDITIONAL UNITS

AUTOMATIC BLANKET CYLINDER CLEANER

BACKGROUND OF INVENTION

This invention relates to a blanket cylinder cleaner and more particularly to a device for automatically removing the debris which collects on the blanket cylinder of an offset lithographic printing press during the printing process.

The invention further relates to an automatic blanket cylinder cleaner which replaces the requirement of manual cleaning and which accomplishes cleaning consistently and expeditiously.

In order to maintain high quality printing, it is necessary to periodically clean the blanket cylinder of a printing press. Since the cleaning process necessarily results in press "down time," it is highly desirable that the amount of "down time" be minimized while at the same time obtaining effective cleaning and drying of the blanket cylinder.

It is known that excessive debris causes a deterioration in print quality. For this reason, it is necessary for the press operator to periodically interrupt the printing process in order to clean debris from the blanket. The procedure followed today in the vast majority of printing plants is to periodically interrupt the printing process and manually clean the blankets while jogging the press. This cleaning operation, which can take as long as ten minutes on a large sheet fed press, usually consists of three steps:

First, the blanket cylinder is wiped with a cloth dampened with water. Since the purpose of this setup is to remove water soluble paper debris, this step is omitted if there is no water soluble paper debris.

Second, the blanket cylinder is wiped clean of all ink using a cloth dampened with ink solvent. Alternatively, the cloth is dampened with water before dampening it with solvent.

Third, a fresh cloth is used to wipe the blanket dry. Although not essential to print quality, the drying step minimizes paper waste when the press begins operation. As a result, in most instances the operator takes the necessary time needed for the drying step.

The development of an automatic blanket cleaner involves several factors to be considered, including the nature of the solvent to be used.

In order to be effective an automatic blanket cleaner must be capable of washing the blanket cylinder with two types of solvent, one for water soluble debris and another for debris insoluble in water. Usually, the solvents are water and a hydrocarbon solvent. When washing debris which is water soluble, such as lint, clay coating and gum, plain water can be used. It has been found that a hydrocarbon solvent is required when the debris is ink based since this type of debris is not soluble in water.

It has also been found that the blanket cleaner must be designed so that it is capable of cleaning the blanket with a relatively mild solvent because a high strength solvent may damage the rubber covering on the blanket cylinder. Solvent power is determined by the KB (kauri-butanol) number. The lower the KB number, the weaker the solvent. A high KB solvent will be absorbed by the rubber blanket material and may cause swelling or damage. Although the maximum allowable KB number solvent which can be used will depend on the particular blanket being used, it is generally recommended that solvents having KB number of 30 or less be used.

The automatic blanket cleaner system must also take into consideration that most hydrocarbon solvents used in blanket washings are not soluble in water. Accordingly, it has been found desirable that the system either have two separate solvent dispensers, or else have provision for generating and maintaining a water-solvent emulsion which can be used for cleaning.

A second problem involves the mechanical loosening of the debris on the blanket cylinder. Frequently, the debris which builds up on the blanket of an offset press adheres to the blanket tenaciously and cannot be easily removed. Thus, to perform under all conditions, an automatic blanket cleaning system must provide for a mechanical loosening or scrubbing action so as to dislodge debris which sticks to the blanket surface so that such debris can be removed.

A third significant factor is that the automatic blanket cylinder cleaning should significantly decrease cleanup time. On a sheet fed press, automatic washup time should not exceed two minutes and preferably should be no more than one minute. On a web press, the washup time should be even less in order to minimize the paper wasted during the washup.

A fourth factor to be considered is that the washup fluid must be confined to the blanket cylinder so as not to contaminate other press parts. It is particularly important that fluid not be allowed to enter the gap in the blanket cylinder where it can subsequently leak out and contaminate the blanket or plate during printing. Also, if solvent seeps under the rubber coating on the blanket cylinder it can cause blanket swelling and/or shorten blanket life. It is equally important to confine water when it is being used as a solvent since water can cause corrosion of press components.

A fifth factor is that the blanket cylinder must be completely dry before printing is resumed. Complete drying is particularly important when the washup liquid is solvent since solvent left on the blanket will contaminate the ink train and cause excessive paper waste on resumption of printing. Similarly, an excess of water left on the blanket following washup can disturb the ink water balance and result in increased paper waste.

Another factor to be considered for blanket cleaner devices is reduction in the consumption of solvent. One reason, of course, is reduction in cost by use of less solvent. However, in web press applications, lower solvent usage is also important in order to reduce the possibility of an explosion in the web press dryer. That is, most web presses used for commercial printing employ heatset inks which are dried by passing the printed web through an oven which drives off the ink solvents by evaporation. If an excessive amount of washup solvent is used, this solvent can cause an explosion when it is carried into the dryer by the web.

Another factor to be considered is reduction of the environmental impact of the cleaning operation. Where the waste material is in liquid form there can be serious problems in the disposal of the liquid wastes since there are many restrictions placed on disposal of such materials. Therefore, where possible, it is desirable that such waste material be in solid form.

Space conservation and compactness must also be considered in developing such equipment. There is very little space available on most printing presses for installation of automatic cleaning equipment. In addition, the installation of such equipment should not obstruct access to either the blanket or plate cylinders since both plates and blankets must be changed periodically.

It is important that the automatic blanket cleaner not generate any foreign particles (hickeys) which could contaminate the press. For example, if a cloth is used as part of the automatic system, it must not produce lint which could show up as hickeys in the subsequent printing operation.

Another significant feature required of automatic blanket cleaners is that they require a minimum of maintenance for reliable operation. This is particularly important on presses which are run around the clock since time spent on maintenance can reduce the time that a press is available for production. In addition, to be efficient the automatic blanket cylinder cleaner should complete its function in about two minutes, and preferably one minute, and should be even less on a web press.

PRIOR ART EFFORTS

There are in the prior art literature or in the prior art practices a variety of different types and forms of blanket cleaners. There has been a significant effort by many different people and organizations to develop an automatic blanket cleaner. In general, these can be categorized as being the spray type, roller type, brush type, or cloth type.

In the spray type device, which is designed primarily for web presses, spray bars are mounted adjacent to each blanket cylinder for applying solvent directly to the blanket. Blanket debris and the ink solvent mixture are carried away by the web. In order to reduce paper waste, the original concept called for blankets to be washed during a paste cycle. Even so, experience has shown that there is consirable paper wasted when blankets are washed with this system. In addition, since the system does not provide for any scrubbing action, the system does a poor job of removing debris which is stuck tenaciously to the blanket. An additional disadvantage of this type is that a rather large volume of solvent is required for washup. This is an especially serious drawback on a web press because of the explosion hazard created when the solvent bearing web enters the dryer.

The roller type device is so named because of the fact that debris is removed from the blanket by one or more rubber rollers which have been dampened with washup solvent. The solvent debris mixture is transferred to an oscillating steel roller from which it is scraped by either a washup blade or a metering or squeegee roller. Ultimately, the liquid waste is collected in a central drain tank. When not in use, the rollers and blade are moved to an out-of-the-way position. This type of blanket cleaner has several drawbacks. Because of the multiplicity of rollers used, the system is not very compact and, therefore, difficult to install on existing presses. In general, this type of system must be designed as an integral part of the press. A second drawback is that the cleaning roller does not provide for a scrubbing action against the blanket and, as a result, debris which clings tenaciously to the blanket cannot be removed. A third disadvantage is the fact that the waste product is in liquid form which is not easily disposed.

The brush type blanket cleaner uses a rotary brush which has been moistened with washup solvent. Following the scrubbing action, the brush is retracted and the blanket is dried by a cloth covered roller. In some instances, the brush is in the form of a belt. Another variation of the rotary brush type utilizes a disc brush mounted on a traversing mechanism which moves the brush back and forth along the length of the blanket cylinder. Although this type of blanket cleaner provides for a scrubbing action, it has the disadvantage that the application of solvent is not confined to the blanket. In addition, the waste in this unit is in liquid form which poses a problem of disposal, as noted above. It also follows that the solvent usage or consumption with this design is relatively high, thereby increasing the cost.

The cloth type of blanket cleaner uses a cloth type web wound around a supply roll. The cloth is transported from the supply roll, past an impression device and onto a take-up roll. A mechanism is provided for advancing the cloth while means are also provided for applying washup solvent to either the cloth or directly to the blanket. Washup is affected by applying solvent, impressing the cloth against the blanket cylinder, and advancing the cloth as necessary.

A web cloth for cleaning a printing press element has been used on intaglio printing presses where wiping cloths of one type or another were used to remove excess ink from the intaglio plates.

Cleaning webs have also been used on automatic blanket washers. In one device, the web is pressed against the blanket cylinder by a sponge type backup device. In addition to acting as the impression device, the sponge is also used to apply solvent to the creped cleaning web. The entire cleaning device is pivotedly mounted so that it can be moved in and out of engagement with the blanket cylinder. The cleaning web is advanced, when so disengaged, in a direction opposite to the travel of the blanket cylinder.

Another variation of the cloth type of blanket cleaner uses crepe paper as the web material. The device was designed for web presses with the intention that the cleaning operation would be accomplished when the web rolls are being changed and the printing machine is normally slowed in its operation. In this type of device, the impression device is a spring loaded roller while the washup solvent is applied directly to the blanket cylinder by a spray unit. The washup web is advanced while engaged with the blanket cylinder, in a direction opposite to the travel of the blanket cylinder.

OBJECTS

With the foregoing in mind, it is an object of this invention to provide a new and improved blanket cylinder cleaner.

Another object of this invention is to provide a new and improved blanket cleaner which can manually or automatically clean a blanket cylinder.

A further object of this invention is to provide a new and improved blanket cylinder cleaner which is compact and efficient in operation.

Another object of this invention is to provide a new and improved blanket cylinder cleaning device adapted to direct a water solvent or hydrocarbon solvent onto a cleaning fabric in conjunction with and having air means for drying the cylinder.

A further object of this invention is to provide a new and improved blanket cleaning device wherein a cleaning fabric is fed intermittently while in contact with a blanket cylinder to clean the same.

Another object of this invention is to provide a new and improved blanket cylinder cleaning device wherein the device is in operational position without moving the entire device with respect to the blanket cylinder.

A further object of this invention is to provide a new and improved blanket cylinder cleaning device having a mechanical cleaning member which can be expanded into operative position and contracted out of operative position.

Another object of this invention is to provide a new and improved blanket cleaning device having a fabric adapted to clean the blanket cylinder wherein means is provided for intermittently feeding the fabric substantially the same amount regardless of the amount of the fabric on the fabric take-up roll.

Another object of this invention is to provide a blanket cylinder cleaning device having a fabric for cleaning the blanket cylinder wherein the fabric is intermittently fed onto a take-up roll wherein means in contact with the fabric on the take-up roll controls the amount of the fabric feed.

A still further object of this invention is to provide a new and improved blanket cylinder cleaner having means for simply and expeditiously changing the fabric after it has been used.

A still further object of this invention is to provide a new and improved blanket cylinder cleaner having means for removing water soluble and non-water soluble debris in cooperation with mechanical means for loosening debris which adheres tenaciously to the blanket cylinder and with means for drying the blanket cylinder.

Additional objects and advantages of the invention will be set forth in the description which follows and, in part, will be obvious from the description, the objects and advantages being realized and obtained by means of the instrumentation, parts, methods and apparatus and procedures particularly pointed out in the appended claims.

BRIEF DESCRIPTION OF THE INVENTION

Briefly described, the present invention includes a cleaning cloth supply roll and a cleaning cloth take-up roll. Between these two rolls are positioned a water dispensing tube, a hydrocarbon solvent dispensing tube and a mechanical loosening means. In this invention, the mechanical loosening means comprising a bladder member which is expanded by air under pressure to move the cleaning cloth into contact with the blanket cylinder to thereby loosen debris on the blanket cylinder.

The invention further includes means connected to the cloth take-up roll for intermittently advancing cloth onto the take-up roll. This means includes means in contact with the cloth on the cloth take-up roll which controls the amount of cloth being fed so that substantially the same amount of cloth is fed during each cloth advance regardless of the amount of cloth on the take-up roll. The invention further includes means for controlling the operation of the cleaning device either automatically or manually.

The invention consists of the novel parts, steps, constructions and improvements shown and described.

The accompanying drawings which are incorporated in and constitute part of this specification illustrate an embodiment of the invention and together with the description serve to explain the principles of the invention.

OF THE DRAWINGS

Figure 1:
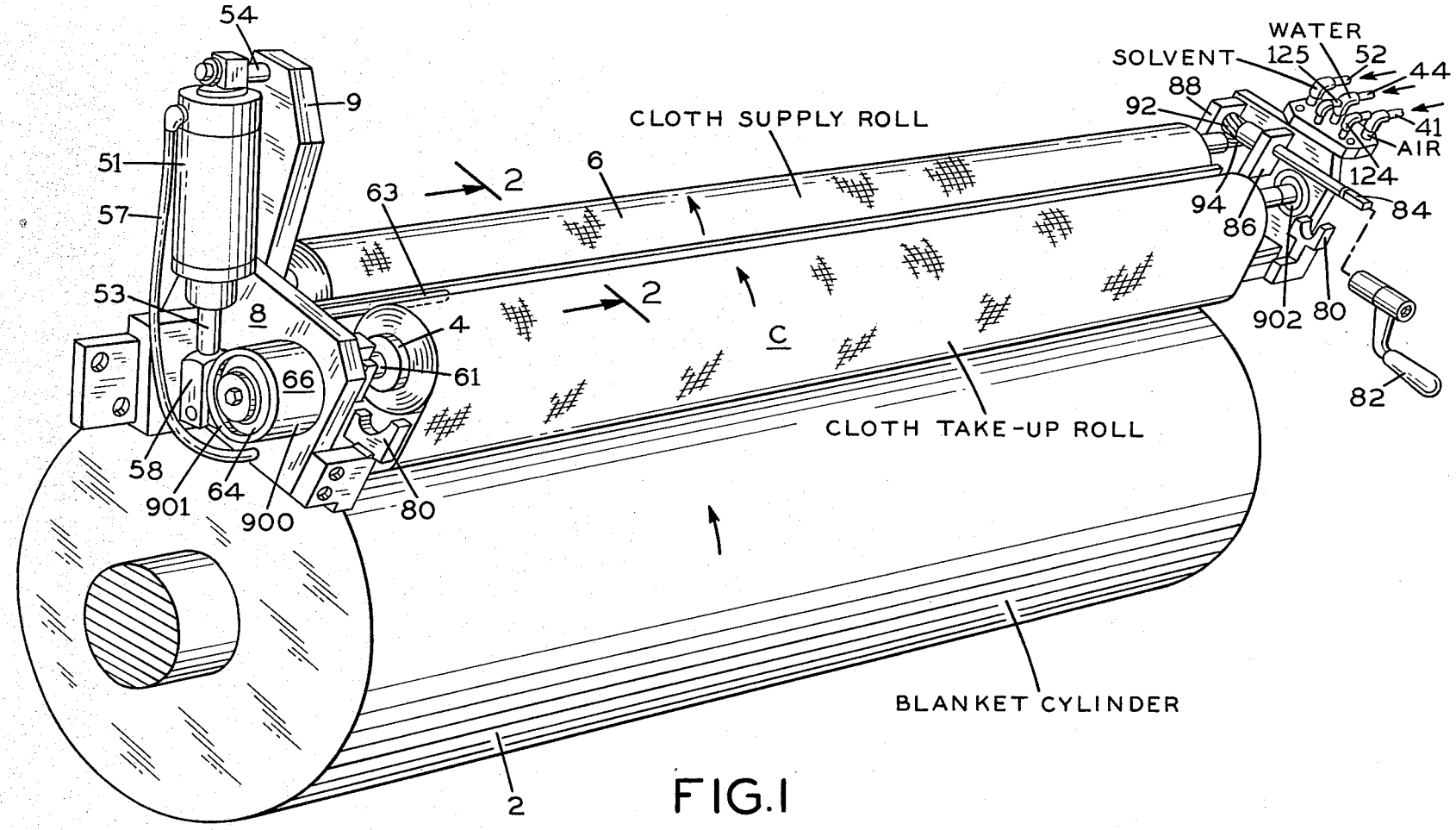
FIG. 1 is a perspective showing of the automatic blanket cylinder cleaner of this invention in use.
Figure 3:
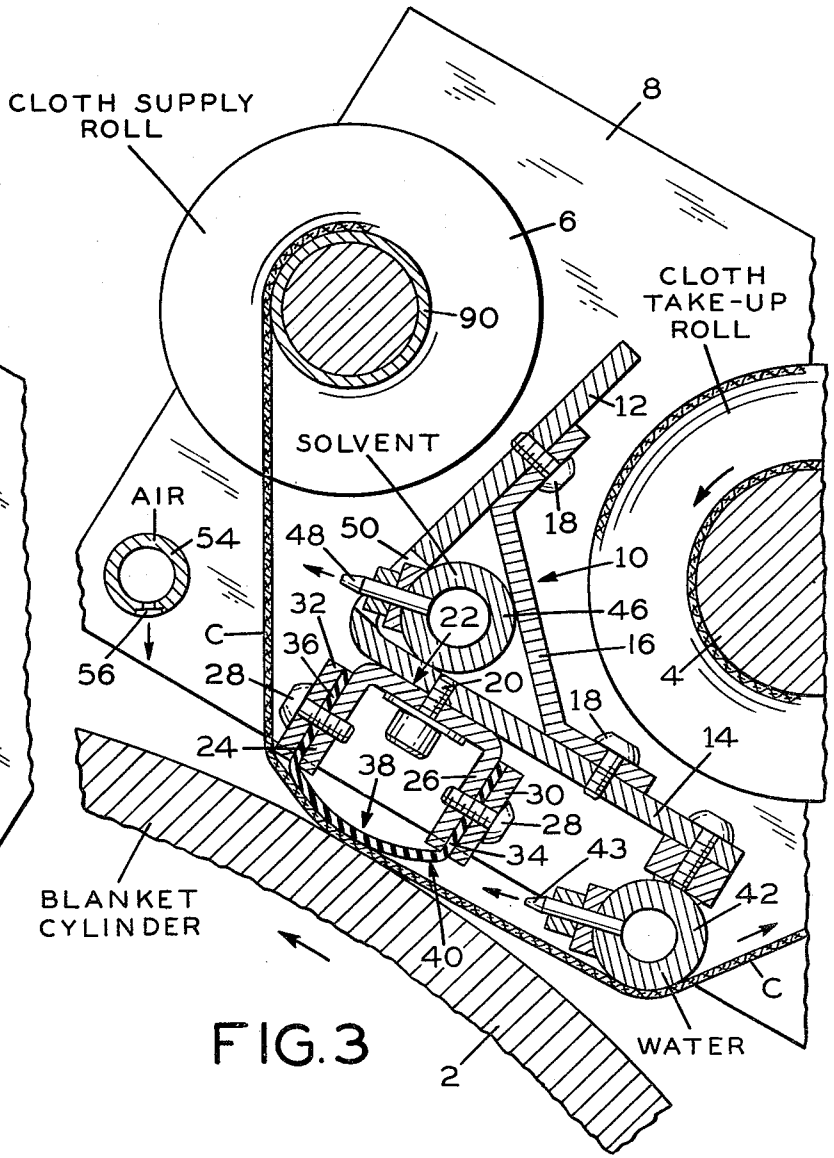
FIG. 3 is a section similar to FIG. 2, showing the bladder inflated, with the cleaning cloth in engagement with the blanket cylinder.
Figure 2:
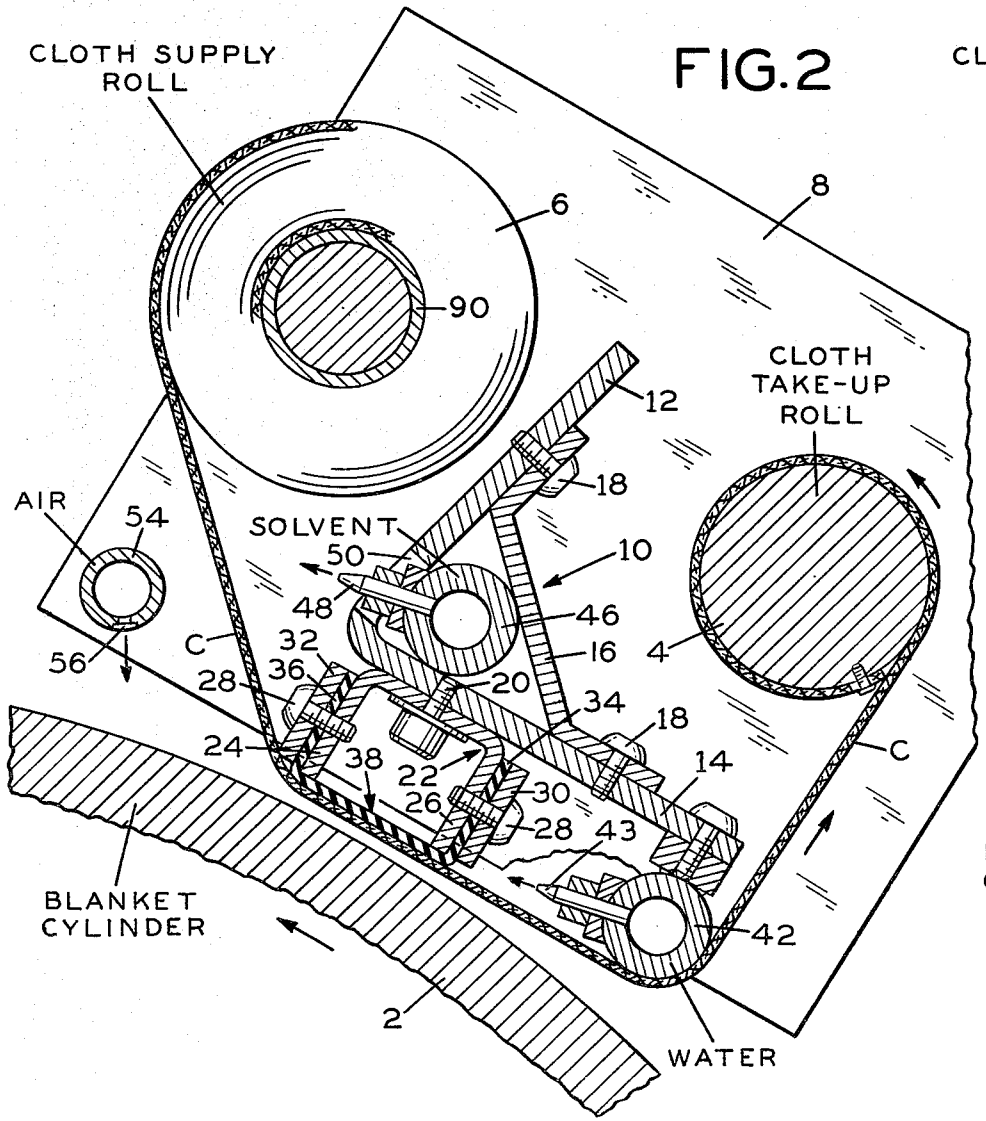
FIG. 2 is a vertical section taken along line 2—2 of FIG. 1 showing the bladder not inflated, and the cleaning cloth spaced away from the blanket cylinder.

Referring to FIGS. 1-3 of the drawings, there is shown thereon a blanket cylinder 2, a cloth take-up roll 4 and a cloth supply roll 6 which can be suitably mounted on a stationary frame such as side frames 8. For convenience only, one of the side frames 8 is illustrated. A cleaning cloth "C" goes from the supply roll to the take-up roll.

The cloth "C" used in the blanket cleaning operation should have certain qualities, e.g., it should be absorbent to both water and solvent and be uniform in its absorbency. In other words, the cloth should not have openings or apertures such as found in a lattice type weave. The cloth should have sufficient abrasion resistance so as not to shed lint or other particles which produce what are known in the trade as "hickeys." The cloth must also have mechanical strength to avoid breakage and be soft enough so as not to scratch the blanket cylinder.

The preferred cloth material is manufactured by Chicopee Manufacturing Company and is non-woven cloth type 5065.

Extending between the side frames 8 is an essentially L-shaped support member 10 positioned generally between the blanket cylinder 2, the cloth take-up roll 4 and the cloth supply roll 6. The L-shaped support member 10 includes a generally vertically disposed leg 12 and a generally horizontally-directed leg 14. Extending between the legs 12 and 14 is a brace member 16 which is suitably attached to legs 12 and 14 such as by screw means 18. The brace member 16 gives support member 10 rigidity and strength. The support member 10 is attached to the side frames 8 in any convenient manner.

In accordance with this invention a unique mechanical scrubbing means is provided for mechanically cleaning the blanket cylinder and which can be moved into operational position in a simplified manner without the use of gears and levers, etc.

Attached to the bottom surface of the generally horizontal leg 14 of the support member 10 by any suitable means such as, for example, screw means 20, is a substantially U-shaped manifold member 22. Attached to the legs 24, 26 of the U-shaped manifold 22 by screw means 28 or the like are the substantially rectangular clamp members 30, 32 which clamp the legs 34, 36 of the rubber bladder means 38 which is made of rubber or the like to the manifold 22. The manifold 22 and the bladder 38, it will be appreciated, extend the length of the blanket cylinder 2 and and between the end plates 8. The manifold 22 is connected in any convenient manner to a supply of compressed air coming from conduit 41. The compressed air supply is typically found in factories as a matter of course.

As can be seen from a comparison of FIGS. 2 and 3 by filling the manifold 22 with air under pressure, the lower surface 40 of the bladder 38 will move from the inoperative position of FIG. 2 to the operative position of FIG. 3 where the cloth "C" has been moved into engagement with the surface of the blanket cylinder 2 to thereby clean the same. This is done in a sequentially-controlled manner as will be seen.

The use of a flexible bladder as the mechanical cleaning means or scrubbing means offers several advantages over other types of mechanical cleaning means.

The use of the bladder instead of a roller, brush or sponge, for example, permits the construction of a more compact device because complicated and expensive mechanisms are not required to move the cleaning means into and out of operative position. The use of the bladder as a mechanical scrubbing means permits the use of the blanket cleaner of this invention with a large number of different types and sizes of presses. The compactness of the unit also permits the solvent to be applied close to the bladder blanket contact point so as to minimize the amount of cloth used per wash cycle. In addition, the bladder does not easily become contaminated with ink and also provides a relatively wide and uniform stripe along the blanket cylinder which substantially eliminates the presence of streaks on the blanket after cleaning. Further, the bladder is cleaned much easier than a brush or the like having bristles.

In accordance with this invention, means is provided to clean the blanket of water soluble and non-water soluble debris which is on the blanket cylinder and to dry the blanket cylinder after being cleaned by the solvent.

As embodied, there is a first tubular member 42 having a plurality of openings or jets 43 along the length of the tubular member 42. The tubular member is connected at one end to a water supply means 44 which can be typical factory water. As shown, the outer surface of the tubular member 42 serves as a guide for the cleaning cloth prior to being taken up on the cloth take-up roll 4. A second tubular member 46 is positioned between the legs of the L-shaped member and has a plurality of jets 48 which extend through openings 50 extending along the length of the tubular member 46.

This second tubular member 46 is connected to a supply of non-aqueous solvent such as a hydrocarbon solvent by a conduit means 52 (FIG. 1).

There is a third tubular member 54 having a plurality of jets or openings 56 positioned along the length of the tubular member 54. The jets or openings are directed towards the surface of the blanket cylinder 2 so as to direct pressurized air within the tubular member 54 onto the surface of the blanket cylinder so as to dry the water or non-aqueous or hydrocarbon solvent remaining on the blanket after the cloth has been retracted.

In accordance with this invention, means is provided for advancing the cloth in an optimum manner. It has been found that the amount of cloth needed to clean the blanket cylinder is dependent upon the manner in which the advancement of the cloth is synchronized with the rotation of the blanket cylinder. It has been found, for example, that a length of about one-eighth ($\frac{1}{8}$th) of an inch of a solvent moistened cloth is required to remove the ink from the circumferential length of the blanket cylinder of about one inch. In other words, it has been found that for optimum cleaning, the ideal blanket cleaner would use a stripe, i.e., width of cloth engaging the blanket cylinder, of one-eighth ($\frac{1}{8}$th) the circumferential length of the blanket cylinder and would be in impression or engagement therewith for one revolution of the blanket cylinder. As a practical example, a blanket cylinder having a circumference of twenty (20) inches would be cleaned of ink in one revolution by a cloth stripe having a width of two and three-eighth's ($2\frac{3}{8}$ths) inches. On the other hand, if a narrower stripe is used, the same result can be obtained by moving the cloth at a rate which is one-eighth ($\frac{1}{8}$th) the rate of the blanket cylinder circumferential travel rate.

In accordance with this invention, means is provided for incrementally advancing the cleaning cloth in a simple and economic manner. This advancing means advances the cleaning cloth independently of the amount of cloth on the supply and take-up rolls and minimizes the possibility of the cleaning cloth or web being drawn into the press and wrapped around press rollers or cylinders.

As embodied this means includes a cylinder 51 and an operatively associated piston 53. The cylinder-piston combination is pivotally attached with respect to an extension 9 of the end plate 8 by the pivot rod 54. The piston 53 is driven by compressed air directed to the cylinder 51 through air line 57 and is returned to its starting position by a spring 49 (FIG. 9C). The piston 53 terminates in a clevis 58 which is connected to arm 60 of advance crank 66 by the pivot 62. The arm 60 is connected to hollow drive shaft 900 which has a reduced diameter 67 at one end and a bore 901 at the other end. The bore 901 contains a one-way clutch 64 which drives the take-up roll in only one direction, namely, the counter-clockwise direction as shown in FIGS. 1–3. The one-way clutch 64 includes a driven shaft 61 passing through hollow drive shaft 900 and which is adapted to be connected to the take-up roller 4. The shaft 61 is free to be driven in one direction by the advance crank 66 and is prevented from moving in the other direction by a second one-way clutch 902 located at the other end of the shaft 4. The one-way clutches are not shown in detail since they are conventional in construction and are commercially available as Model FS05 from Formsprag Company, Warren, Mich.

In operation the air cylinder 51 is alternately driven and returned to cause advance crank 66 to rotatably oscillate through some angle. When driven in the counterclockwise direction, advance crank 66 engages with and drives shaft 61 by means of one-way clutch 64. When the advance crank 66 is driven in the clockwise direction the one-way clutch 64 is disengaged and the take-up roller shaft 4 is prevented from rotating in the clockwise direction by the one-way clutch 902. It is in this manner that the cylinder 51 imparts an incremental advance movement to the cloth.

As noted the invention provides for substantially uniform incremental advancement of the cloth regardless of the amount of cloth in the cloth take-up roller. This means includes a travelling crank pin 63 which in turn will control the limits of movement of the advance crank 66 in such a way that the cloth advancement will be substantially the same regardless of the amount of cleaning cloth "C" on the take-up roller 4.

Figure 7:
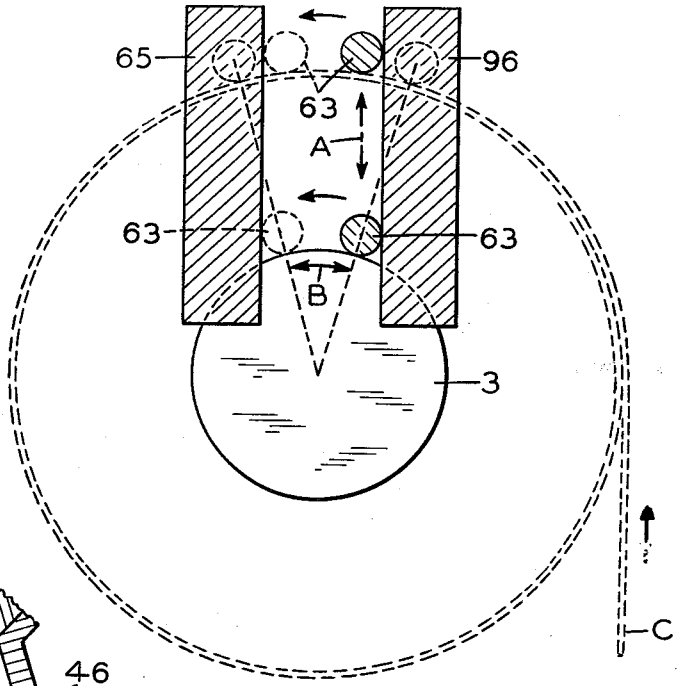
FIG. 7 is a diagram showing the relationship between the diameter of the cloth take-up roll, and the movement of the crank pin.

As embodied, the crank pin 63, referred to herein as the travelling crank pin since its position changes with the amount of cloth on the take-up roller, is positioned in engagement with the periphery of the cloth on the cloth take-up roll as shown in FIG. 1 and FIG. 7.

Figure 4:
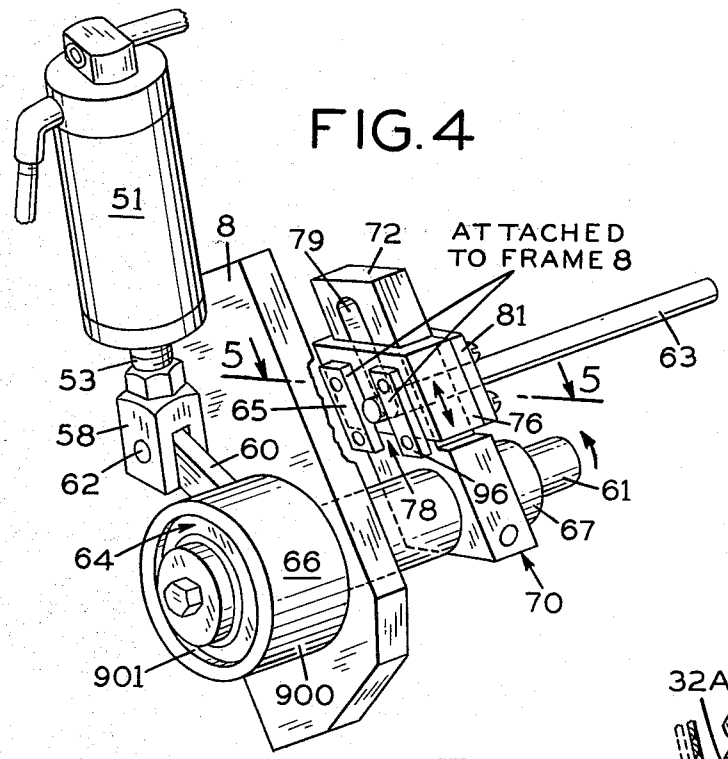
FIG. 4 is a perspective showing of the air cylinder, one-way clutch, and crank pin.

Fixedly attached to a reduced diameter section 67 of the advance crank drive shaft 900 is a crank arm 70 having a reduced section 72 with a slot 79 therein as shown in FIG. 4.

Figure 5:
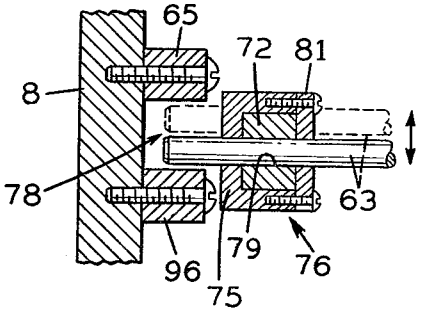
FIG. 5 is a section taken along line 5—5 of FIG. 4.

The reduced section 72 of the crank arm 70 is adapted to slidably receive a travelling pin carrier 76. The travelling pin carrier 76 consists of pin 63, carriage 75 and end plate 81. The travelling pin carrier 76 slides up and down the reduced section 72 depending on the amount of cloth on the take-up roller. In other words as additional cleaning cloth is taken up by the take-up roller 4, the travelling pin 63 moves radially outwardly and the travelling pin carrier slides outwardly on the reduced section 72. In addition, the travelling pin 63 moves through an arcuate path in response to motion of advance crank 66. Means is provided for controlling the limits of such arcuate movement. As embodied, this means includes a slot 78 (FIG. 5) in which the end of the travelling crank pin 63 moves. The movement, however, of the crank pin 63 is limited by the stops 65, 96 which are part of the end plate 8. The stops 65, 96 could be in the form of plates 65, 96 such as illustrated in FIG. 4 or could be the ends of a slot formed in end plate 8. In any event the movement of the travelling pin 63 is limited by these stops which can be spaced different distances to provide adjustability.

When travelling crank pin 63 is driven by the advance crank 66 in the counter-clockwise direction, the take-up roll will take up the cloth from the cloth supply roll 6. When, however, the travelling crank pin 63 is driven into engagement with the stop 65, cylinder 51 will not drive advance crank 66 against such resistance and there will be no further movement of the cloth take-up roller and hence no further cloth advance.

In other words, the travelling crank pin 63 and the stops limit the angular movement of the take-up roll, during one stroke of the piston 53 which provides an essentially constant increment of cloth advance, regardless of the amount of cloth on the take-up roll.

The movement of the travelling pin 63 is illustrated in somewhat schematic form in FIG. 7. There the cloth take-up roll is shown in the beginning of the operation by the full line circle 3 whereas the dotted circle shows the take-up roll after a significant amount of cleaning cloth "C" has been fed onto the take-up roll.

As can be seen in FIG. 7, as the amount of cleaning fabric on the take-up roll increases the travelling pin 63 moves radially outwardly since the travelling pin 63 is maintained in continuous engagement with the surface of the fabric take-up roller by the force of gravity. This radial movement is illustrated by the arrow "A", FIG. 7.

In addition, of course, the travelling pin 63 has an angular movement about the axis of the take-up roll by virtue of its relationship with the advance crank 70.

As shown in FIG. 7, if unobstructed, the travelling pin 63 when moving through an angle "B" would move a greater distance when the take-up roll is relatively full (dotted line position) than when the take-up roll is relatively empty (full line position). In order to control the movement of the travelling pin 63 the stops 65, 96 are provided so that the arcuate movement of the travelling pin is substantially the same regardless of the amount of cleaning cloth on the take-up roll. There is an insignificant difference in the amount of movement due to the different radii involved. However, their difference could be corrected if the difference was considered significant by changing the angularity of the stops.

As will be appreciated, the travelling pin 63 by virtue of its relationship with the advance crank 66 and the stop means limits the turning movement of the take-up roll and hence the amount of cleaning cloth which intermittently engages the blanket cylinder.

In accordance with this invention means is provided so that the cloth can be replaced simply and expeditiously when required.

It will be understood that in a typical instance there are about ten (10) yards of cloth available for cleaning the blanket cylinder. An average cloth advance would be about three (3) inches and it is possible to obtain about one hundred (100) cleanings or washups of the blanket cylinder with the ten (10) yard cloth supply. It is usually necessary to clean the blanket cylinder about once an hour which means that with the press in operation twenty-four (24) hours a day the cloth must be replaced about once a week. Naturally, it is desirable that this be accomplished in as little time as possible so as to keep the amount of "down time" as low as possible. This is accomplished as follows:

When the take-up roll is full of cloth, the take-up roll is disconnected by hand and is placed on the roller rests 80 attached in any convenient manner to the frame 8. Next, a hand crank 82 is operatively connected to the rewind shaft 84 which is positioned in supports 86, 88. The rewind shaft 84 has a gear 92 in meshing relationship with gear 94 on the supply shaft.

As can be seen in FIG. 2, there is a cardboard tube 90 in telescopic arrangement with the supply shaft. Turning the hand crank 82 will rewind the used cloth onto the cardboard tube 90. The cardboard tube and used cloth can then be removed from the supply shaft and a supply of fresh cloth on a cardboard tube installed on the supply roll.

The take-up roll is removed from the roller rests 80 and re-installed in place. The leading end of the fresh cloth is threaded past the expandable bladder, the water supply tube and onto the take-up roller and the cleaning device is again ready for operation.

In accordance with this invention, there are five (5) basic systems for controlling the operation of the cleaning device of this invention. These systems are: liquid dispensing and spray (water or non-aqueous solvent); air bladder; cloth advance; and air spray. These systems are shown in schematic form in FIGS. 9A–9D.

Figure 9A:
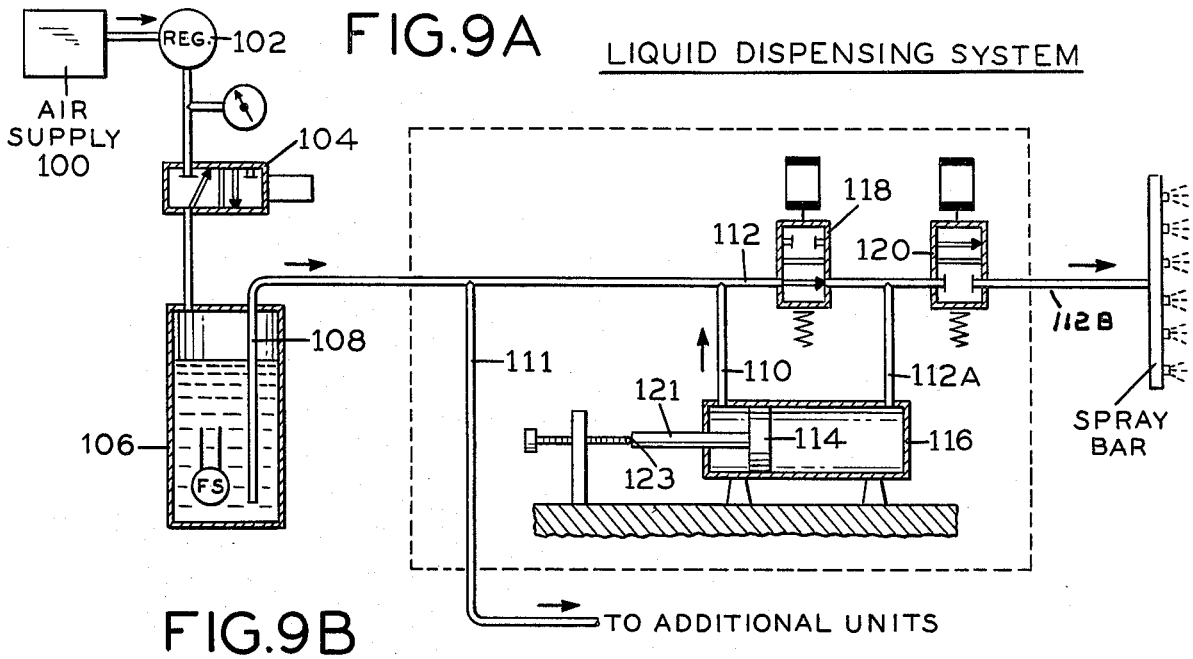
FIG. 9A is a schematic view of the control system for the liquid dispensing system.

The liquid dispensing and spraying system shown in FIG. 9A is identical for the non-aqueous or hydrocarbon solvent and for the water supply. For this reason, to simplify this description, only one system is shown and described.

In addition, it should be noted that only one system each for each press is illustrated. In practice additional (5 or 6) units would be operated by the same basic system.

The first step is to load the system with fluid. This is accomplished, as follows:

As shown, there is a pressurized air supply 100 (conventional factory air) fed to a pressure regulator 102 and through valve 104. There is a liquid reservoir 106 having a conduit 108 extending below the liquid level. The conduit 108 has branches 110, 111 and 112. Conduit 111 leads to other units having the same control system. Branch 110 leads to the rod side of piston 114 in cylinder 116. Conduit 112 has branch 112A leading to the large side of piston 114 and branch 112B leading to the spray tube. There are valves 118 and 120 in lines 112 and 112B, respectively.

In operation, with valve 118 open and valve 120 closed, liquid is fed to both sides of the piston 114 and owing to the area differential the piston will move to the left until the adjustable screw stop 123 engages with the piston rod 121. The position of the adjustable screw determines the amount of fluid to be dispensed. The fluid system is now loaded.

When the system needs fluid, valve 118 is closed and valve 120 is opened so that the piston 114 will be forced to the right (FIG. 9A) due to the lack of resistance, thus discharging the fluid through valve 120 and to the tube 42 via fitting 44 (FIG. 1) or tube 46 via fitting 52 (FIG. 1) depending whether water or a non-aqueous solvent is used.

Figure 9B:
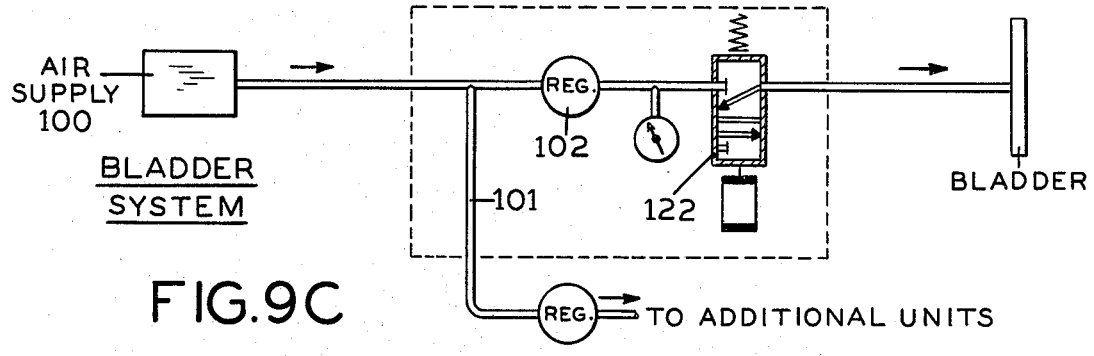
FIG. 9B is a schematic view of the control system for the expandable bladder system.
Figure 9C:
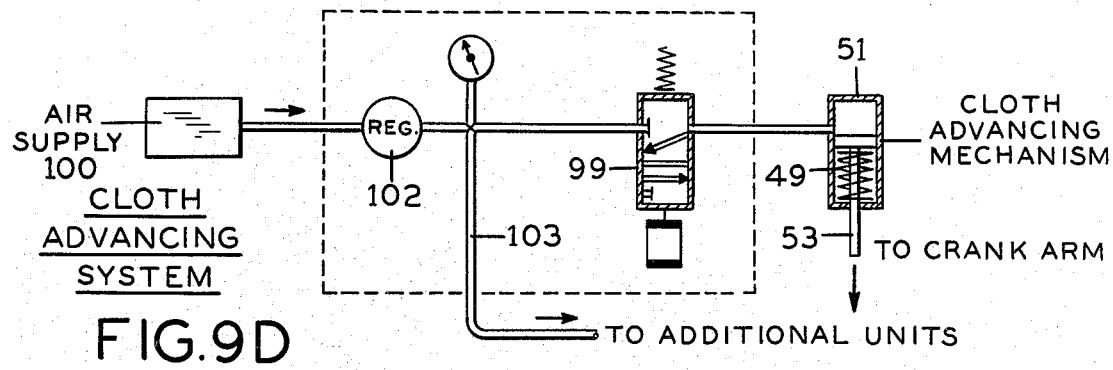
FIG. 9C is a schematic view of the control system for the cleaning cloth advancing system.

The system for supplying air to the bladder to expand the same is shown in FIG. 9B. In this system the factory air supply 100 is directed through the regulator 102 an if the three-way solenoid valve 122 is open, to the air bladder. The controlled air is communicated to the bladder via fitting 41 (FIG. 1). As noted, there is also a conduit 101 adapted to be connected to other units.

The cloth advance system is shown in FIG. 9C. In this system the air supply 100 goes through a regulator 102 and then to a three-way solenoid valve 99. If the three-way solenoid valve is open, air is fed to the cylinder 51 via fitting 124 (FIG. 1) to actuate the piston 53 and cause the take-up roll to turn as explained above. The piston 53 is returned to its starting position by the spring return means 49 when the valve 99 closes. As noted, there is also a conduit 103 adapted to be connected to other units.

Figure 9D:
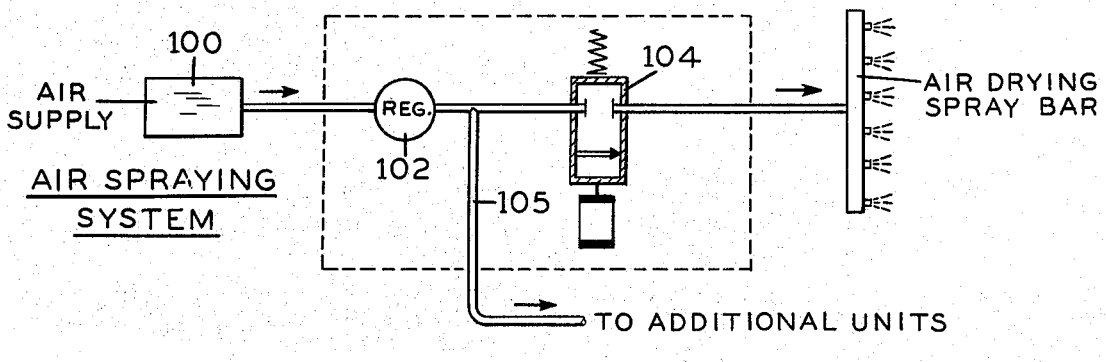
FIG. 9D is a schematic view of the control system for the air spraying or drying system.

The air spray or drying system is illustrated in FIG. 9D. In this system air supply 100 goes through regulator 102 and to the two-way solenoid valve 104. The valve 104 is controlled so that air is directed to the air spray tube at the end of the cleaning cycle. There is also a conduit 105 adapted to be connected to other units.

CONTROL SYSTEM

Figure 10:
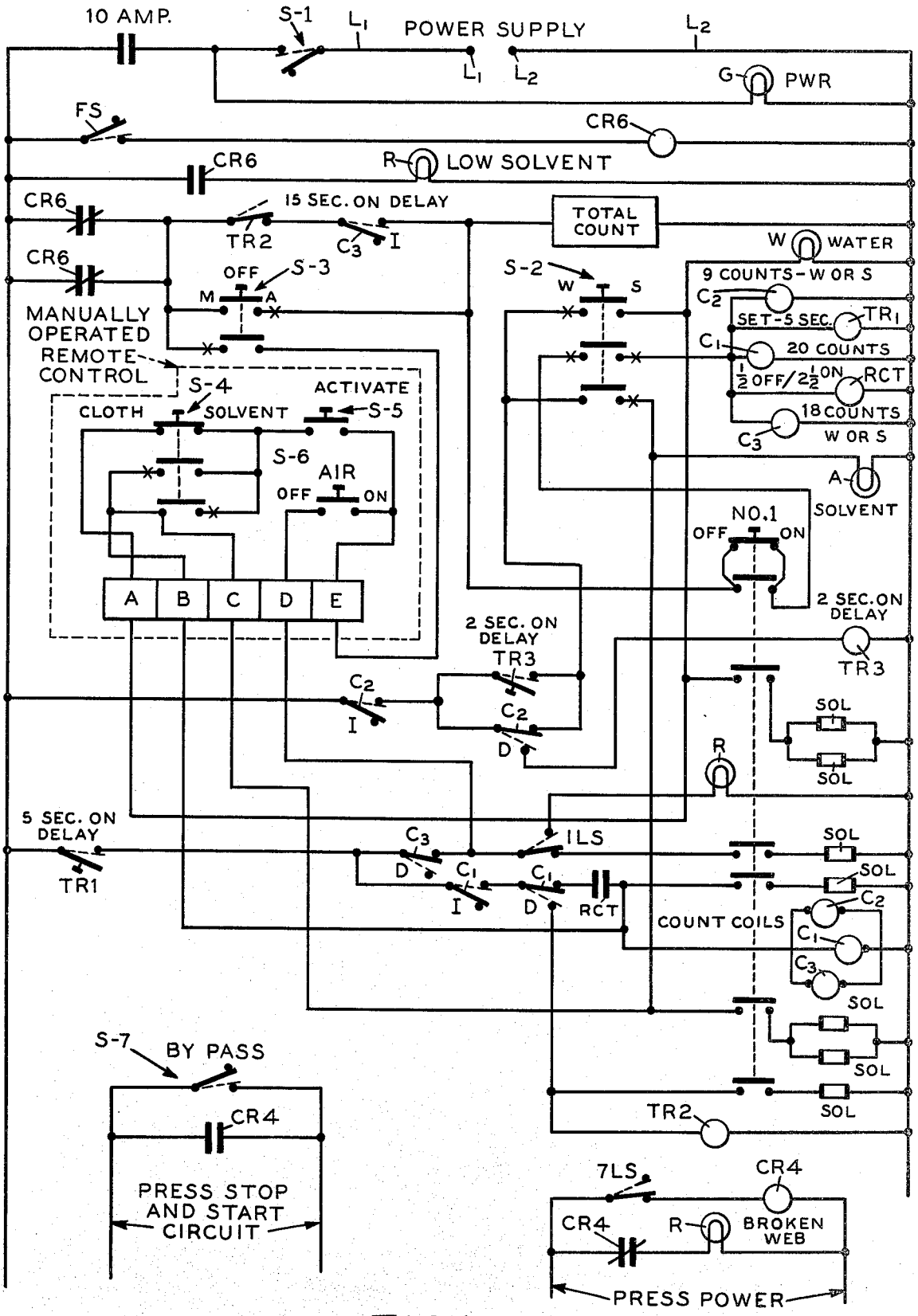
FIG. 10 is a schematic view of the electrical control system for the blanket cleaner.

The control system for the present invention is shown in FIG. 10. All switches, relays, etc. are shown in the position they are in before any power is applied to the system. It discloses an automatic and manual mode of operation for operating one blanket cylinder cleaning device. It will be understood in actual practice the control system operates up to six or more blanket cleaning devices.

The basic electrical power for the system comes from line L1 and L2. When switch S1 is closed, power is directed to the central circuit and energizes the power in light. Float switch FS (FIG. 9A) is normally open provided there is sufficient fluid in the solvent supply tank. Should the level of liquid solvent be low the switch FS would be closed energizing the low solvent light and relay CR 6. If the solvent level is low the operator manually fills the solvent supply tank.

If there is sufficient solvent, power is directed to control mode selector switch S-3.

The switch S-2 is used to select either the water or solvent cleaning cycle by moving the switch in "W" or "S". At this point, the operator would determine and operate switches to select the printing units to be cleaned. The switch S-2 establishes a power path directly to the solvent system solenoid valves, i.e., water or hydrocarbon solvent, and the five timer relays C2, TR1, C1, RCT and C3. Either the water or solvent light will go on depending on the cycle selected.

With power on (S-1), solvent in the tank (F.S.), and wash mode selected (S-2), the system can be placed in an automatic wash mode by momentary energizing S-3 to the automatic mode position. At this point, the following sequence will occur.

1. The five timer relays C2, TR1, C1, RCT and C3 are energized along with the wash mode indicator light.
2. The solenoids for either water or hydrocarbon solvents are actuated causing a measured amount of fluid to be sprayed on the cloth through the jets on tubes 42 or 46. The manner in which the measured amount of fluid is determined has been explained.
3. At this point, timer relay TR1 (set for 5 sec.) allows the fluid to spread on the cloth so that the cloth will be thoroughly wet with the cleaning fluid.
4. After 5 seconds time relay TR1 closes causing the air bladder to energize through delayed contact C3. Power is also sent to repeat cycle timer (RCT) by instantaneous contact C1 and delayed contact C1.
5. The repeat cycle time RCT continuously cycles to apply power to the cloth advance mechanisms for two and one-half ($2\frac{1}{2}$) seconds and to remove power for one-half ($\frac{1}{2}$) second. During the one-half ($\frac{1}{2}$) second off period, the cloth advance mechanism is spring returned in readiness for the next incremental advance. The on/off closures of the RCT also pulse the count coils of C1, C2 and C3.
6. After the nine pulses of RCT, C2 (which is preset to operate after 9 counts) operates through its delayed contact to energize TR3 (set for two (2) seconds). TR3 allows two (2) seconds for the solvent dispensing cylinders to retract so that they can be again filled with liquid (See FIG. 9A).
7. After two (2) seconds delayed TR3 contact closes and reestablishes power to the solvent system causing a second measured amount of solvent (i.e. water or hydrocarbon as pre-determined) to be sprayed on the cloth.
8. RCT continues to supply on/off power pulses to the cloth advance mechanism and to the count coils of C1, C2 and C3.
9. After 18 total counts, C3 (preset at 18 counts) operates to remove air from the expandable bladder through its delayed contact C3.
10. After 20 total counts, C1 (preset at 20 counts) operates through delayed contact C1 which removes power from the cloth advance mechanism. The cloth advance mechanism operates for two (2) cycles after air is removed from the bladder to enable the take-up mechanism to allow any slack to be removed from the cloth. At this point, the air spray solenoid valves are energized as well as Timer TR2.

11. After 15 seconds, TR2 operates to break power to the control system, thus ending the wash cycle.

In some instances, the automatic system is not desired, in which event the manual control system is used. This may occur for testing purposes or at the beginning of the cycle for evaluation purposes.

The switch S-3 when placed in the manual mode supplies power to the manual remote control station. The automatic controls are not utilized in this mode. Switch S-4 is used to preselect either cloth advance, water spray or solvent spray. Momentary switch S-5 is used to pulse the mode as selected by S-4. Switch S-6 is used to apply or remove air to the air bladder.

The manual control station is on a pendant cable thus allowing the operator to bring it to the printing unit being checked out.

During the manual mode, printing unit selector switch No. 1 is effective so that any particular unit or combination thereof are selectable.

Limit switch 1LS is used to detect the remaining usable cloth on the ABC unit. When the cloth supply roll is at an end, the limit switch disables the air bag and operates a low cloth light on the control panel.

Limit switch 7LS is used to detect a broken cloth web. When actuated, it operates relay CR4 which in turn shuts off the press and lights an indicator light on the control panel.

Printing unit selector switch No. 1 has one pole that is make/break/make. If the switch is activated during an automatic wash mode, the entire cycle will be aborted.

Figure 8:
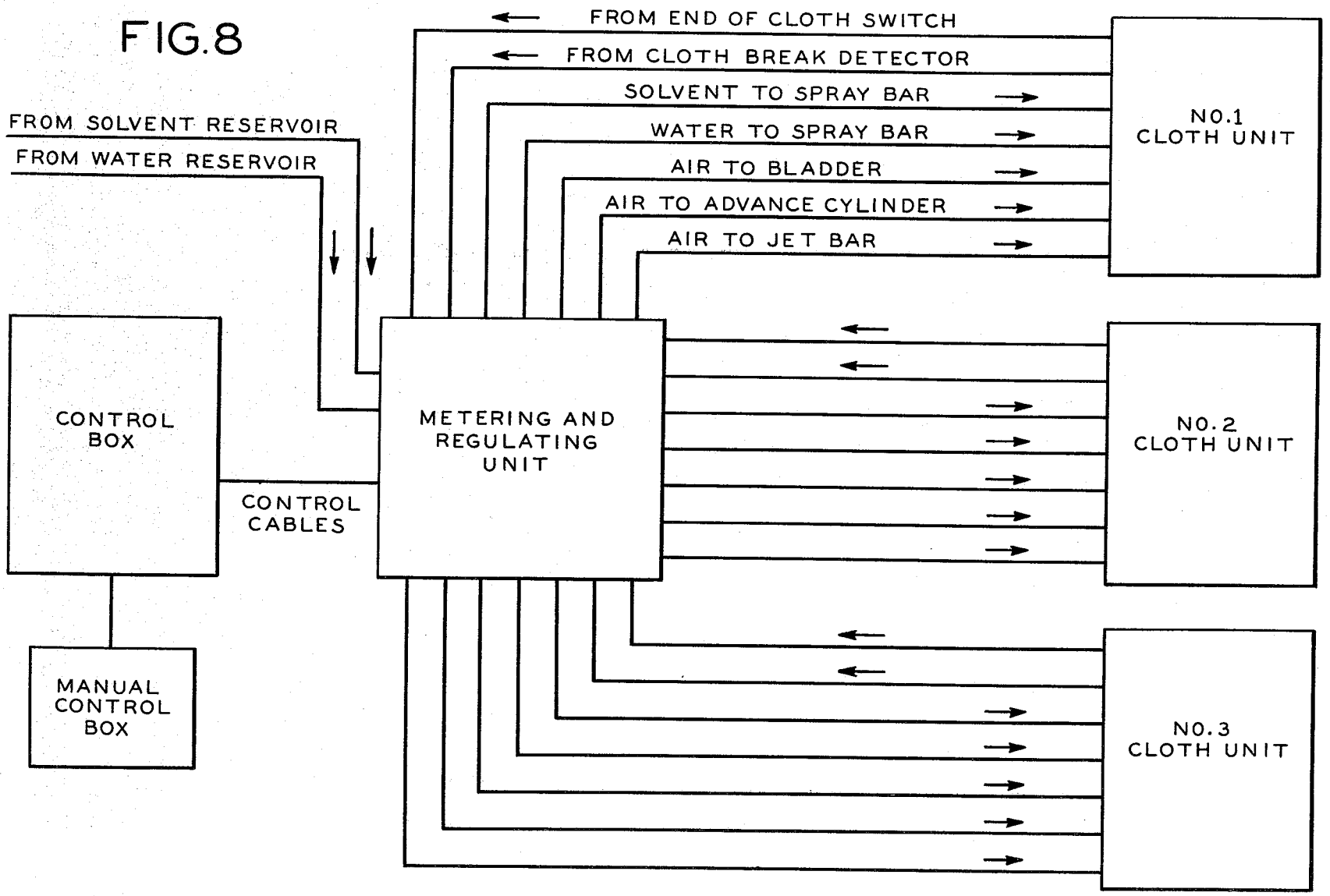
FIG. 8 is a block diagram showing the interconnection of the automatic blanket cylinder cleaner, with a three unit press.

FIG. 8 shows the overall operation of the device.

As indicated in that drawing there is a control box for automatic operation and a manual control box which is electrically connected to the metering and regulation unit. As shown the metering and regulating unit is operatively associated with No. 1, No. 2 and No. 3 cloth unit, although there could be a greater or smaller number of cloth units. There are conduits sending solvent from a reservoir and from a water supply directed to the metering and regulating unit. The receiver signals from each of the cloth units whenever the end of the cloth supply is reached or there is a break in the cloth supply. As noted above, such a signal would stop the operation of the device.

The metering and regulating unit sends impulses so that either solvent or water is directed to the cloth units followed by pressurized air to the expandable bladder to cause expansion of the same and to the cloth advance mechanism. Thereafter, air is directed to the blanket so as to dry the same.

Figure 6:
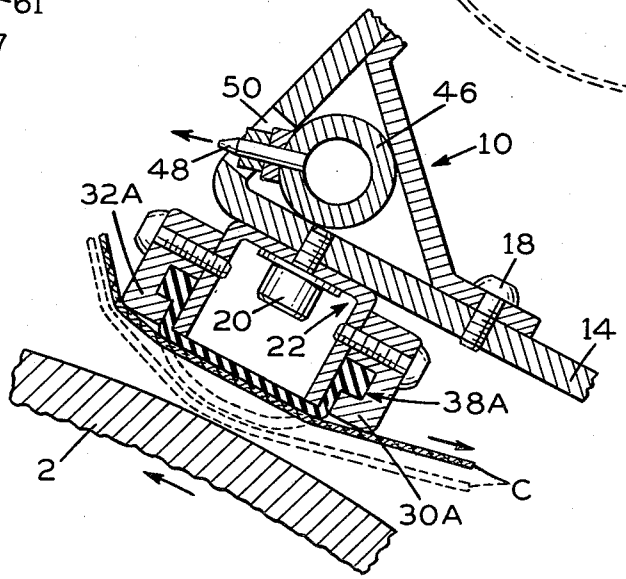
FIG. 6 is a fragmentary showing, similar to FIG. 2 of a modified bladder capable of filling a wider space between it and the blanket.

FIG. 6 shows another embodiment of the expandable bladder 38A. In this embodiment the bladder is made of molded rubber and is connected to the manifold in any convenient manner such as the recessed clamps 30A, 32A engaging flanges on the manifold. As can be seen from a comparison of the dotted line to the full lines this embodiment provides a greater space between the bladder and the blanket roller when in the relaxed position.

What is claimed is:

1. A device for cleaning the rotating blanket cylinder of a printing press with a cleaning fabric comprising:

(a) frame means adjacent said blanket cylinder;

(b) means supported by said frame including a cloth supply roll and a cloth take-up roll for mounting the cleaning cloth adjacent said blanket cylinder;

(c) feeding means cooperating with said take-up roll for incrementally feeding substantially the same amount of cloth during each incremental feeding of the fabric regardless of the amount of cloth on the take-up roll;

(d) means for moving the cloth in a direction opposite from the blanket cylinder;

(e) an expandable bladder on said frame which causes the cleaning fabric to contact the blanket cylinder when in the expanded condition;

(f) pneumatic means for expanding said bladder;

(g) said feeding means including power means attached to said frame;

(h) one-way clutch means operatively associated with said power means to drive said take-up roller in one direction;

(i) control means in engagement with the cleaning cloth on said take-up roll, said control means controlling the amount of angular movement of said take-up roll depending on the amount of cleaning cloth on said cleaning cloth take-up roll;

(j) said control means including a crank arm operatively associated with said one-way clutch adapted to rotate with the shaft driven by said one-way clutch;

(k) carrier means on said crank arm and adapted to move radially with respect to the axis of said take-up roll along said crank arm;

(l) travelling pin means operatively associated with said carrier, said travelling pin being maintained in engagement with the cleaning cloth on said take-up roll and being adapted more radially with respect to the axis of said take-up roll with said carrier means and being adapted to be move in an arcuate path with said carrier means about the axis of said take-up roll; and (m) stop means on said frame adapted to engage said travelling pin and to limit rotational movement.

2. A device for cleaning the rotating blanket cylinder of a printing press comprising:

(a) a frame;

(b) a cleaning fabric;

(c) a cleaning fabric supply roll mounted with respect to said frame;

(d) a cleaning fabric take-up roll mounted with respect to said frame, and means for guiding said cleaning fabric from said supply roller past the blanket cylinder and to said take-up roll;

(e) expandable bladder means mounted with respect to said frame adjacent the blanket cylinder and adapted to move the cleaning fabric into and out of engagement with the blanket cylinder;

(f) a liquid solvent means mounted with respect to said frame and adapted to direct liquid solvent onto said cleaning fabric;

(g) air drying means mounted with respect to said frame and adapted to direct drying air to said blanket cylinder to dry the same;

(h) feed control means for intermittently turning the take-up roll so that the same length of cleaning fabric is fed past the blanket cylinder in a direction opposite to the direction of the blanket cylinder for each intermittent feeding of cleaning fabric regardless of the amount of cleaning fabric on the take-up roll;

(i) means for controlling the sequence and timing of the device;

(j) said control means including power means adapted to rotate said take-up roll in only one direction;

(k) pin means adapted to engage the cleaning fabric on said take-up roll;

(l) means for mounting said pin means with respect to said take-up roll so that said pin means can move radially of the axis of said take-up roll and can move arcuately with respect to the axis of said take-up roll when said take-up roll is rotated by said power means; and (m) stop means positioned to engage said pin means to thereby limit the rotational movement of said take-up roll.

3. A device for cleaning the rotating blanket cylinder of a printing press comprising:

(a) a frame;

(b) a cleaning fabric;

(c) a cleaning fabric supply roll mounted with respect to said frame;

(d) a cleaning fabric take-up roll mounted with respect to said frame, and means for guiding said cleaning fabric from said supply roller past the blanket cylinder and to said take-up roll;

(e) expandable bladder means mounted with respect to said frame adjacent the blanket cylinder and adapted to move the cleaning fabric into and out of engagement with the blanket cylinder;

(f) a liquid solvent means mounted with respect to said frame and adapted to direct liquid solvent onto said cleaning fabric;

(g) air drying means mounted with respect to said frame and adapted to direct drying air to said blanket cylinder to dry the same;

(h) feed control means for intermittently turning the take-up roll so that the same length of cleaning fabric is fed past the blanket cylinder in a direction opposite to the direction of the blanket cylinder for each intermittent feeding of cleaning fabric regardless of the amount of cleaning fabric on the take-up roll; and (i) means for controlling the sequence and timing of the device;

(j) said control means includes means for engaging the cleaning fabric on the take-up roll for controlling the amount of rotation of said take-up roll.

4. A device as defined in claim 3 wherein said liquid solvent means includes:

(a) a first tubular member having openings therein for directing water onto said cleaning fabric; and (b) a second tubular member having openings therein for directing a non-aqueous solvent onto said cleaning fabric.

5. A device as defined in claim 3 wherein said air drying means includes a third tubular member having openings therein for directing air onto said blanket cylinder, said third tubular member being positioned so that the air is directed to said blanket cylinder so as to dry the blanket cylinder after cleaning.

6. A device as defined in claim 3 having electrical means for determining the sequence of operation of said device.

7. A device as defined in claim 3 having return means for returning the used cleaning fabric to the supply roll.

8. A device as defined in claim 3 wherein said return means includes:

(a) a shaft adapted to be turned by a hand crank;

(b) means for supporting said shaft;

(c) means on which said take-up roll can be placed and be freely rotatable; and (d) gear means on said shaft and gear means on said supply roll whereby upon rotation of said shaft said supply roll is turned so as to receive cloth from said take-up roll.

9. A device as defined in claim 3 having:

(a) means for automatically controlling the sequence and timing of the device.

10. A device as defined in claim 3 having:

(a) means for manually controlling the sequence and timing of the device.

11. A device as defined in claim 3 having means for determining the sequence of operation of said device.

12. A device as defined in claim 3 where said feeding means comprises:

(a) power means attached to said frame;

(b) one-way clutch means operatively associated with said power means to drive said take-up roller in one direction; and (c) control means in engagement with the cleaning cloth on said take-up roll, said control means controlling the amount of angular movement of said take-up roll depending on the amount of cleaning cloth on said cleaning cloth take-up roll.

* * * * *